US006203854B1

(12) United States Patent
Affinito

(10) Patent No.: US 6,203,854 B1
(45) Date of Patent: Mar. 20, 2001

(54) METHODS OF AND COMPOSITIONS FOR PREVENTING CORROSION OF METAL SUBSTRATES

(75) Inventor: John C. Affinito, McHenry, IL (US)

(73) Assignee: Brent International PLC, Bucks (GB)

( * ) Notice: Subject to any disclaimer, the term of this patent is extended or adjusted under 35 U.S.C. 154(b) by 0 days.

(21) Appl. No.: 09/154,251

(22) Filed: Sep. 16, 1998

Related U.S. Application Data

(60) Provisional application No. 60/059,197, filed on Sep. 17, 1997.

(51) Int. Cl.[7] ..... B05D 3/02

(52) U.S. Cl. ..... 427/327; 427/376.4; 427/384; 427/388.4; 427/419.8; 427/443.2; 106/14.15; 106/14.21; 106/287.11

(58) Field of Search ..... 427/338.4, 419.8, 427/384, 327, 376.4, 443.2; 106/287.11, 14.15, 14.21

(56) References Cited

U.S. PATENT DOCUMENTS

| | | | | |
|---|---|---|---|---|
| 3,038,818 | * | 6/1962 | Findlay | 427/419.8 |
| 3,619,281 | * | 11/1971 | Tomlinson | 427/381 |
| 3,627,565 | * | 12/1971 | Plueddemann | 427/419.8 |
| 3,639,131 | * | 2/1972 | Clarke | 106/2 |
| 5,053,081 | * | 10/1991 | Jacob | 106/287.11 |
| 5,108,793 | | 4/1992 | van Ooij et al. | 427/327 |
| 5,292,549 | | 3/1994 | van Ooij et al. | 427/156 |
| 5,397,390 | * | 3/1995 | Gorecki | 106/287.11 |
| 5,650,474 | * | 7/1997 | Yamaya et al. | 528/12 |
| 5,667,845 | * | 9/1997 | Roberto et al. | 427/419.8 |
| 5,693,371 | | 12/1997 | Rodzewich et al. | 427/421 |
| 5,720,902 | * | 2/1998 | Zefferi et al. | 252/389.31 |
| 5,750,197 | * | 5/1998 | 'van Ooij et al. | 427/388.4 |
| 5,753,304 | * | 5/1998 | Tung | 427/438 |
| 5,756,158 | * | 5/1998 | Pilz et al. | 427/388.4 |
| 5,789,085 | * | 8/1998 | Blohowiak et al. | 427/388 |
| 5,801,217 | | 9/1998 | Rodzewich et al. | 523/409 |
| 5,807,430 | * | 9/1998 | Zheng et al. | 106/287.11 |
| 5,859,106 | * | 1/1999 | Jones et al. | 427/388.4 |
| 5,907,382 | * | 5/1999 | Kajiura et al. | 349/158 |
| 5,952,049 | * | 9/1999 | Tomlinson | 427/388.4 |

FOREIGN PATENT DOCUMENTS

| | | |
|---|---|---|
| 2110461 | 12/1993 | (CA) . |
| 0153973 | 9/1985 | (EP) . |
| 0358338 | 9/1989 | (GB) . |
| 0391442 | 6/1990 | (JP) . |
| 9521277 | 8/1995 | (WO) . |
| 9715700 | 5/1997 | (WO) . |

OTHER PUBLICATIONS

The interphase in painted metals pretreated by functinal silanes; J. Adhesion Sci. Technol. vol. 7, No. 11, pp. 1153–1170 (1993) VSP 1993.

On the Use, Characterization and Performance of Silane Coupling Agents Between Organic Coatings and Metallic or Ceramic Substrates, pp. 30–321, American Institute of Physics, 1996.

Paint adhesion and corrosion performance of chromium–free pretreatments of 55% Al–Zn–coated steel; J. Adhesion Sci. Technol., vol. 10, No. 9 pp. 883–904 (1996) VSP 1996.

* cited by examiner

*Primary Examiner*—Erma Cameron
(74) *Attorney, Agent, or Firm*—Andrus, Sceales, Starke & Sawall, LLP

(57) ABSTRACT

A method for protecting a metal substrate from corrosion comprises the steps of providing a metal substrate and applying a treatment solution to the surface of the metal substrate, wherein the treatment solution comprises a partially hydrolyzed aminosilane and a fluorine-containing inorganic compound. Preferably the metal substrate is selected from the group consisting of aluminum, aluminum alloys and mixtures thereof.

23 Claims, No Drawings

METHODS OF AND COMPOSITIONS FOR PREVENTING CORROSION OF METAL SUBSTRATES

This application claim benefit to provisional application No. 60/059,197 filed Sep. 17, 1997.

TECHNICAL FIELD

This invention relates to methods of and compositions for preventing corrosion of metal substrates. More particularly, the method comprises applying a solution containing an aminosilane and a fluorine-containing inorganic compound to a metal substrate. The method is useful for both preventing corrosion and as a treatment step prior to painting, particularly for metal substrates comprising aluminum or aluminum alloys.

BACKGROUND ART

Most metals are susceptible to corrosion, in particular atmospheric corrosion. Such corrosion will significantly affect the quality of such metals, as well as that of the products produced therefrom. Although this corrosion may sometimes be removed from the metal, such steps are costly and may further diminish the utility of the final product. In addition, when polymer coatings such as paints, adhesives, or rubbers are applied to the metal, corrosion of the base metal material may cause a loss of adhesion between the polymer coating and the base metal. A loss of adhesion between the polymer coating and the base metal can likewise lead to corrosion of the metal. Aluminum alloys are particularly susceptible to corrosion as the alloying elements used to improve the metal's mechanical properties (e.g., magnesium and zinc) will decrease corrosion resistance.

Prior art techniques for improving corrosion resistance of metal, particularly metal sheet, include passivating the surface by means of a heavy chromate treatment. Such treatment methods are undesirable, however, because the chromium is highly toxic, carcinogenic and environmentally undesirable. It is also known to employ a phosphate conversion coating in conjunction with a chromate rinse in order to improve paint adherence and provide corrosion protection. It is believed that the chromate rinse covers the pores in the phosphate coating, thereby improving the corrosion resistance and adhesion performance. Once again, however, it is highly desirable to eliminate the use of chromate altogether. Unfortunately, the phosphate conversion coating is generally not optimally effective without the chromate rinse.

Recently, various techniques for eliminating the use of chromate have been proposed. These include coating the metal with an inorganic silicate followed by treating the silicate coating with an organofunctional silane (U.S. Pat. No. 5,108,793). U.S. Pat. No. 5,292,549 teaches the rinsing of a metal sheet with a solution containing an organofunctional silane and a crosslinking agent in order to provide temporary corrosion protection. The crosslinking agent crosslinks the organofunctional silane to form a denser siloxane film. One significant drawback of the methods of this patent, however, is that the organofunctional silane will not bond well to the metal surface, and thus the coating of U.S. Pat. No. 5,292,549 may be easily rinsed off. Various other techniques for preventing the corrosion of metal sheets have also been proposed. Many of these proposed techniques, however, are ineffective, or require time-consuming, energy-inefficient, multi-step processes.

Thus, there is a need for a simple, low-cost technique for preventing corrosion of metals, particularly aluminum or aluminum alloys, as well as for treating a metal substrate prior to applying polymer coatings such as paints, adhesives, or rubbers.

SUMMARY OF INVENTION

It is an object of this invention to obviate the various problems of the prior art, particularly to obviate the problems associated with chromate use and disposal.

It is another object of this invention to provide improved methods of preventing corrosion of metals.

It is yet another object of this invention to provide improved methods of treating metal surfaces prior to the application of organic polymer coatings, particularly paints, adhesives and rubbers.

In accordance with one aspect of the present invention there is provided a method for treating a metal substrate, comprising the steps of providing a metal substrate and applying a treatment solution to the surface of the metal substrate, wherein the treatment solution comprises a partially hydrolyzed aminosilane and a fluorine-containing inorganic compound. If desired, a polymer coating such as paints, adhesives, or rubbers, may thereafter be applied directly over top of the conversion coating provided by the treatment solution.

In accordance with another aspect of the present invention there is provided a method for coating a metal substrate comprising the steps of providing a metal substrate; cleaning the metal substrate; applying to the surface of the metal substrate a treatment solution comprising a partially hydrolyzed aminosilane and a fluorine-containing inorganic compound to form a conversion coating; and drying the metal substrate.

In accordance with another aspect of the present invention there is provided a method for coating a metal substrate comprising the steps of providing a metal substrate; cleaning the metal substrate; rinsing the metal substrate with water; applying to the surface of the metal substrate a treatment solution comprising an aminosilane and a fluorine-containing inorganic compound to form a conversion coating; optionally rinsing the metal substrate with water, followed by drying the metal substrate In accordance with yet another aspect of the present invention there is provided a treatment solution comprising a partially hydrolyzed aminosilane and a fluorine-containing inorganic compound.

In accordance with another aspect of the present invention there is provided a method for treating a metal substrate prior to applying a polymer coating, comprising the steps of providing a metal substrate and applying a treatment solution to the surface of the metal substrate, wherein the treatment solution comprises a partially hydrolyzed aminosilane and a fluorine-containing inorganic compound.

It has been found that treatment solutions comprising an aminosilane and a fluorine-containing inorganic compound not only provide good corrosion protection, but also provide good polymer adhesion. Methods according to the present invention do not require the step of deoxidizing the substrate with an acidic solution to remove oxides, resulting in a more efficient process which generates less wastes, and require fewer water rinses, thereby conserving water resources. Further, treatment solutions according to the present invention do not require organic solvents. The treatment solutions can be "refreshed" by supplementation of additional ingredients when titration results indicate the levels of ingredients have fallen below the preferred ranges.

These and additional objects and advantages will be more fully apparent in view of the following detailed description.

DETAILED DESCRIPTION OF THE INVENTION

It has been found that corrosion of metal, particularly aluminum and aluminum alloys, can be prevented by applying a treatment solution containing an aminosilane and a fluorine-containing inorganic compound to the surface of the metal. It has also been found that the treatment solution is useful for treating metal substrates prior to applications of organic coatings such as paints, adhesives, and rubbers.

The treatment methods of the present invention may be used on any of a variety of metals, including aluminum (in sheet form, extrusion and cast), and aluminum alloy (in sheet form, extrusion and cast). Preferably the metal substrate is selected from the group consisting of aluminum, aluminum alloys and mixtures thereof. More preferably the substrate is an aluminum alloy which contains little or no copper. It should be noted that the term "metal sheet" includes both continuous coil as well as cut lengths.

The treatment solution comprises one or more aminosilanes, which have been at least partially hydrolyzed, and one or more fluorine-containing inorganic compounds. Preferably the aminosilane is an aminoalkyl alkoxy silane. Useful aminoalkyl alkoxy silanes are those having the formula $(\text{aminoalkyl})_x\,(\text{alkoxy})_y$ silane, wherein x is greater than or equal to 1, and y is from 0 to 3, preferably from 2 to 3. The aminoalkyl groups of the $(\text{aminoalkyl})_x\,(\text{alkoxy})_y$ silane may be the same or different, and include aminopropyl and aminoethyl groups. Suitable alkoxyl groups include triethoxy and trimethoxy groups. Suitable aminosilanes include γ-aminopropyltriethoxylsilane, aminopropyltrimethoxysilane, aminoethylaminopropyltrimethoxysilane, aminoethylaminopropyltriethoxysilane, aminoethylaminoethylaminopropyltrimethoxysilane and mixtures thereof. A preferred aminosilane is γ-aminopropyltriethoxysilane (γ-APS).

Preferably the fluorine-containing inorganic compound is selected from the group consisting of titanium fluoride, fluorotitanic acid ( $H_2TiF_6$ ), fluorozirconic acid ($H_2ZrF_6$), fluorohafnic acid ($H_2HfF_6$) and mixtures thereof. More preferably the fluorine-containing inorganic compound is a fluorine-containing inorganic acid, even more preferably the fluorine-containing inorganic acid is selected from the group consisting of fluorotitanic acid, fluorozirconic acid, fluorohafnic acid and mixtures thereof.

Preferably the treatment solution is at least substantially free of chromate, more preferably completely free of chromate.

As used herein, percentages and ratios are by weight unless specified otherwise. The weight percentages of aminosilane are based on the weight of unhydrolyzed aminosilane added to the solution, unless specified otherwise.

The aminosilanes are generally available in an aqueous solution of from about 90% to 100%, by weight of the total unhydrolyzed aminosilane added to the solution. Fluorine-containing inorganic compounds such as fluorotitanic acid, fluorozirconic acid, fluorohafnic acid and mixtures thereof are generally available in aqueous solutions of about 50% to about 60%, by weight. The treatment solution of the present invention preferably comprises from about 0.2% to about 3%, more preferably from about 0.2% to about 1%, by weight, of the aminosilane solution and preferably from about 0.1% to about 2%, more preferably from about 0.1% to about 0.5%, by weight, of the fluorine-containing inorganic compound solution; the remainder of the treatment solution is water (preferably deionized). In one preferred embodiment the treatment solution comprises about 5.25 g/l of an about 90%, by weight, aqueous solution of γ-APS (approximately 5.0 g/l γ-APS) and about 2.5 g/l of an about 60%, by weight, aqueous solution of fluorotitanic acid (approximately 1.5 g/l fluorotitanic acid); the remainder of the solution is water (preferably deionized).

The ratio of aminosilane to fluorine-containing inorganic compound is preferably from about 0.5:1 to about 2:1, more preferably about 2:1, by weight. The pH of the solution is preferably no greater than about 6, more preferably no greater than about 5, and most preferably less than about 5.

The treatment solution does not require the use of crosslinkers such as bis-(triethoxysilyl)ethane silane (BTSE), or bis-(trimethoxysilyl)ethane silane (TMSE). Preferably the composition will be free of silane crosslinkers.

The treatment solution is prepared by adding a small amount of water (preferably deionized) to the aminosilane solution (about 90% to 100% aminosilane, by weight), mixing, and allowing this mixture to stand overnight or until clear. The amount of water added to the aminosilane solution is generally in the range of from about 4% to about 5% of the total volume of water and aminosilane solution. This results in at least a partial hydrolysis of the aminosilane. The resulting aminosilane mixture is then combined with the fluorine-containing inorganic compound solution and the remaining water (preferably deionized). Although organic solvents may be added, they are generally not necessary. Compatible organic solvents are water-soluble organic solvents, including glycol ethers and water-soluble alcohols such as methanol, ethanol and isopropanol. Preferably the treatment solution will be substantially free of, more preferably entirely free of, organic solvents.

The bath life of the treatment solution is at least up to about two days. However, the bath life of the treatment solution can be extended by supplementing the treatment solution with additional aminosilane and fluorine-containing inorganic compound in order to bring the levels of the ingredients back to the preferred levels. The levels of ingredients can be titrated by methods known in the art, and one of ordinary skill can calculate the amount of ingredients to add.

The treatment solution is applied to the surface of the metal substrate. Application may be accomplished by spraying, dipping, rolled coating or "no-rinse" applying or other means well known to those skilled in the art. In one embodiment the metal substrate is dipped into a bath comprising the treatment solution. Preferably the metal substrate is dipped in the bath for a period of time of from about 2 seconds to about 5 minutes, more preferably from about 15 seconds to about 2 minutes, most preferably from about 1 minute to about 2 minutes. The temperature of the treatment solution can be maintained in the range of from ambient temperature to about 150° F. (66° C.), preferably from about 100° F. (38° C.) to about 120° F. (49° C.), most preferably about 120° F. (49° C.). Generally ambient temperature is from about 60° F. (16° C.) to about 75° F. (24° C.), preferably from about 65° F. (18° C.) to about 70° F. (21° C.). Preheating the metal substrate is not required, and is preferably omitted in order to improve process efficiency.

In a preferred embodiment metal substrates are protected from corrosion, or treated prior to application of a organic coating, by a method comprising cleaning the metal substrate (such as by alkaline cleaning); rinsing the metal substrate with water; applying to the surface of the metal substrate the treatment solution; optionally rinsing the metal substrate with water; and drying the metal substrate. The metal substrate may be dried in an oven for a time sufficient to dry the substrate, generally from about 2 minutes to about 30 minutes. A preferred drying temperature range is from ambient temperature to about 180° F. (82° C.), more preferably from ambient temperature to about 150° F. (65° C.), most preferably from ambient temperature to less than 150° F. (65° C.). After drying, the conversion coating provided by the treatment solution of the present invention will generally be present on the metal substrate at a weight of from about 10 mg/sq.ft. to about 14 mg/sq.ft.

Chromate treatment of metal generally requires: alkaline cleaning the metal substrate; rinsing the metal substrate with water; etching; rinsing the metal substrate with water; deoxidizing metal substrate with an acidic composition to remove surface oxides; rinsing the metal substrate with water; applying to the surface of the metal substrate a chromate treatment solution; rinsing the metal substrate with water; seal rinsing and drying the metal substrate. Thus the traditional chromate treatment requires four water rinses, an alkaline cleaning, a seal rinsing and an acidic deoxidation step in addition to the chromate treatment step. In contrast, the present methods may include only two water rinses and a cleaning step in addition to the treatment step, and do not require a deoxidation step. Although the methods according to the present invention may include the steps of etching, deoxidizing and seal rinsing, preferably the methods are free of the steps of etching, deoxidizing and seal rinsing. The absence of the etching, deoxidizing and seal rinsing steps results in a quicker, more cost-effective process and a decrease in effluent handling.

The treatment solution and methods of the present invention also provide a conversion coating upon which paints and other polymers may be directly applied.

Corrosion and delamination of paint will often spread from a small region of exposed metal (i.e., a scratch in the painted surface) over a period of time (referred to as "creepage" or "creepback"). Metal substrates treated according to the present invention exhibit both good paint adhesion and good corrosion resistance, even when subjected to scribing (exposure of a region of bare metal).

The conversion coating of the present invention was applied to panels of 6061 aluminum alloy in accordance with the teachings of the present invention. A clear coating was thereby provided, and no visible marks were present. A portion of the panels were then coated with a standard electrophoretic coating ("E-coat") or a standard powder coating. Panels were then subjected to corrosion and adhesion testing, including the tests described in United States Military Specification MIL-E-5541E, incorporated herein by reference. Panels having only the conversion coating (no E-coat or powder coating) demonstrated no pits after 336 hours of exposure (ASTM B117 Salt Spray Test, incorporated herein by reference). The first pit was visible after 1344 to 1416 hours. For the powder coated panels, a film thickness of approximately 68 microns was observed. Creepage was first observed on the powder coated panels after 504 to 528 hours, and there was no adhesion failure observed after 3096 hours. Creepage was first observed on the electrophoretic coated panels after 1680 to 1752 hours, and there was no adhesion failure observed after times in the range of from 2256 to 2382 hours.

Corrosion resistance was also demonstrated using a scribe test. For the E-coat panels, film thickness was approximately 12 microns, and once again no adhesion failure was observed. Corrosion resistance of the E-coat panels was also demonstrated using a scribe test. These tests demonstrate that conversion coatings provided by the treatment solutions of the present invention provide excellent corrosion resistance and no loss of adhesion between the conversion coating and polymeric coatings applied over top thereof.

Having described the preferred embodiments of the present invention, further adaptions of the methods and compositions described herein can be accomplished by appropriate modifications by one of ordinary skill in the art without departing from the scope of the present invention. A number of alternatives and modifications have been described herein, and others will be apparent to those skilled in the art. Accordingly, the scope of the present invention should be considered in terms of the following claims, and is understood not to be limited to the details of the methods and compositions shown and described in the specification.

I claim:

1. A method for coating a metal substrate, comprising the steps of:

(a) providing a metal substrate; and (b) contacting the metal substrate with the treatment solution for a period of time of from about 2 seconds to about 5 minutes, wherein the treatment solution is free of silane crosslinkers and comprises a partially hydrolyzed aminosilane and a fluorine-containing inorganic compound, and the coating provided by the treatment solution is present on the metal substrate at a weight of from about 10 mg/sq. ft. to about 14 mg/sq. ft.

2. A method according to claim 1, wherein the metal substrate is selected from the group consisting of aluminum, aluminum alloys and mixtures thereof.

3. A method according to claim 1, wherein the temperature of the treatment solution is from about ambient temperature to about 150° F.

4. A method for protecting a metal substrate from corrosion, comprising the steps of:

(a) providing a metal substrate selected from the group consisting of aluminum, aluminum alloys and mixtures thereof;

(b) cleaning the metal substrate;

(c) applying to the surface of the metal substrate a treatment solution comprising a partially hydrolyzed aminosilane and a fluorine-containing inorganic compound to form a conversion coating; and (d) drying the metal substrate at a temperature of from 60° F. to about 180° F.;

wherein the treatment solution is free of silane crosslinkers, and further wherein after the step of drying the metal substrate the conversion coating provided by the treatment solution is present on the metal substrate at a weight of from about 10 mg/sq. ft. to about 14 mg/sq. ft.

5. A method according to claim 4, wherein the aminosilane is selected from the group consisting of γ-aminopropyltriethoxylsilane, aminopropyltrimethoxysilane, aminoethylaminopropyltrimethoxysilane, aminoethylaminopropyltriethoxysilane, aminoethylaminopropyltrimethoxysilane and mixtures thereof; and the fluorine-containing inorganic compound is selected from the group consisting of titanium fluoride, fluorotitanic acid, fluorozirconic acid, fluorohafnic acid and mixtures thereof.

6. A method according to claim 4, further comprising the step of rinsing the metal substrate with water prior to the step of drying the metal substrate.

7. A treatment solution consisting essentially of:

water;

from about 0.18% by weight to about 3% by weight of an aminosilane; and from about 0.05% by weight to about 1.2% by weight of a fluorine-containing inorganic compound; and wherein the aminosilane is partially hydrolyzed.

8. A treatment solution according to claim 7, wherein the fluorine-containing inorganic compound is selected from the group consisting of titanium fluoride, fluorotitanic acid, fluorozirconic acid, fluorohafnic acid and mixtures thereof.

9. A treatment solution according to claim 7, wherein the aminosilane is selected from the group consisting of γ-aminopropyltriethoxylsilane, aminopropyltrimethoxysilane, aminoethylaminopropyltrimethoxysilane, aminoethylaminopropyltriethoxysilane, aminoethylaminoethylaminopropyltrimethoxysilane and mixtures thereof.

10. A treatment solution according to claim 9, wherein the aminosilane is γ-aminopropyltriethoxysilane and the fluorine-containing inorganic compound is fluorotitanic acid.

11. A treatment solution according to claim 7, wherein the treatment solution is substantially free of chromate.

12. A treatment solution according to claim 7, wherein the pH of the solution is no greater than about 6.

13. A treatment solution according to claim 7, wherein the treatment solution is free of silane crosslinkers.

14. A method for treating a metal substrate prior to applying a polymer coating, comprising the steps of:

(a) providing a metal substrate selected from the group consisting of aluminum, aluminum alloys and mixtures thereof;

(b) contacting the metal substrate with a treatment solution for a period of time of from about 2 seconds to about 5 minutes;

(c) drying the metal substrate at a temperature of from 60° F. to about 180° F.; and (d) applying a polymer coating;

wherein the treatment solution comprises water and from about 0.18% by weight to about 3% by weight aminosilane and from about 0.05% by weight to about 1.2% by weight of fluorine-containing inorganic compound, and further wherein after the step of drying the metal substrate the coating provided by the treatment solution is present on the metal substrate at a weight of from about 10 mg/sq. ft. to about 14 mg/sq. ft.

15. A method according to claim 14, wherein the polymer coating is selected from the group consisting of paints, adhesives, rubbers and mixtures thereof.

16. A method according to claim 1, wherein the treatment solution is free of organic solvents and comprises, by weight, from about 0.18% to about 3%, total, of aminosilane and from about 0.05% to about 1.2% of a fluorine-containing inorganic compound.

17. A method according to claim 1, wherein the treatment solution is prepared by mixing from about 0.2% to about 3%, by weight, of a solution comprising from about 90% to about 100%, by weight, aminosilane and from about 0.1% to about 2%, by weight, of a solution comprising from about 50% to about 60%, by weight, fluorine-containing inorganic compound.

18. A treatment solution according to claim 7, prepared by mixing from about 0.2% to about 3% of a solution comprising from about 90% to about 100% aminosilane and from about 0.1% to about 2% of a solution comprising from about 50% to about 60% fluorine-containing inorganic compound.

19. A treatment solution according to claim 7, comprising approximately 5.0 g/l γ-APS γ-aminopropyl-triethoxysilane and approximately 1.5 g/l fluorotitanic acid.

20. A treatment solution according to claim 7, wherein the treatment solution is free of organic solvents.

21. A treatment solution according to claim 20, wherein the treatment solution is free of silane cross-linkers.

22. A treatment solution according to claim 21, wherein the aminosilane is selected from the group consisting of γ-aminopropyltriethoxylsilane, aminopropyltrimethoxysilane, aminoethylaminopropyltrimethoxysilane, aminoethylaminopropyltriethoxysilane, aminoethylaminoethylaminopropyltrimethoxysilane and mixtures thereof; and the fluorine-containing inorganic compound is selected from the group consisting of titanium fluoride, fluorotitanic acid, fluorozirconic acid, fluorohafnic acid and mixtures thereof.

23. A treatment solution according to claim 22, wherein the treatment solution is prepared by mixing water with from about 0.2% to about 1%, by weight, of a solution comprising from about 90% to about 100%, by weight, aminosilane and from about 0.1% to about 0.5%, by weight, of a solution comprising from about 50% to about 60%, by weight, fluorine-containing inorganic compound.

* * * * *